United States Patent [19]

Kiczek et al.

[11] Patent Number: 4,614,490

[45] Date of Patent: Sep. 30, 1986

[54] METHOD AND APPARATUS FOR ATOMIZING FUEL

[75] Inventors: Edward F. Kiczek, Long Valley, N.J.; Mervyn J. Beckner, Sarnia, Canada; Emiliano Trimon, Tanki Leendert, Netherlands Antilles

[73] Assignee: Exxon Research and Engineering Co., Florham Park, N.J.

[21] Appl. No.: 718,804

[22] Filed: Apr. 1, 1985

[51] Int. Cl.[4] ..... F23J 7/00; B05B 7/06

[52] U.S. Cl. ..... 431/4; 431/163; 431/354; 239/431

[58] Field of Search ..... 431/4, 163, 190, 354; 239/399, 403, 404, 429, 430, 431, 433, 434, 434.5

[56] References Cited

U.S. PATENT DOCUMENTS

| | | | |
|---|---|---|---|
| 1,653,297 | 12/1927 | Labelle | 239/431 |
| 2,566,040 | 8/1951 | Simmons | 239/431 X |
| 3,092,332 | 6/1963 | Bickel et al. | 239/430 X |
| 3,650,476 | 3/1972 | Rackley et al. | 239/431 |
| 3,829,015 | 8/1974 | Monro | 239/102 |
| 3,904,119 | 9/1975 | Watkins | 239/431 X |
| 4,141,505 | 2/1979 | Reich | 239/431 |
| 4,152,108 | 5/1979 | Reed, et al. | 431/188 |
| 4,221,558 | 9/1980 | Santisi | 431/186 X |
| 4,406,610 | 9/1983 | Duijvestinj | 431/4 |

FOREIGN PATENT DOCUMENTS

| | | | |
|---|---|---|---|
| 1019171 | 5/1983 | U.S.S.R. | 239/431 |

*Primary Examiner*—Margaret A. Focarino

*Attorney, Agent, or Firm*—Donald F. Wohlers; Joseph J. Dvorak

[57] ABSTRACT

In accordance with the present invention an improved liquid fuel atomizing gun and method is disclosed wherein optimal efficiency atomization is accomplished by introducing liquid fuel under pressure in a first swirling spiral direction into a mixing chamber. The mixing chamber also includes means for introducing steam through a plurality of inclined orifices to introduce the steam and impact the sprayed liquid fuel in a contra-rotational swirl direction. This arrangement of opposite swirling directions of the injected fuel and steam in the gun mixing chamber produces maximum turbulence between the two fluids as each impinge upon the other in relative close proximity so that the kinetic energy of each stream, both oil and steam, is released as the opposing streams meet. The impact of such opposed liquid fuel and steam streams produces higher Reynolds numbers which result in additional turbulence for enhanced mixing.

11 Claims, 3 Drawing Figures

METHOD AND APPARATUS FOR ATOMIZING FUEL

BACKGROUND OF THE INVENTION

The present invention relates to an improved liquid fuel atomizing gun for use in a burner of the type where steam is used as the atomizing fluid.

Liquid fuel atomizing guns employing steam are well known in the prior art and typical examples thereof may be seen by reference to U.S. Pat. Nos. 3,829,015 and 4,152,108. In each of these prior art patents steam is used as a propelling medium to assist in atomizing the liquid fuel as it is sprayed from the gun tip of the atomizer. The effectiveness in atomizing the liquid fuel as it is sprayed into a combustion chamber of an associated burner will, in part, determine the amount of excess combustion air that must be supplied to the burner in order to accomplish complete combustion of the atomized fuel. The higher the efficiency or degree of atomization accomplished, the lower the amount of excess air that will have to be supplied to the burner while maintaining acceptable flame shapes. Therefore, if the amount of excess air can be reduced the overall efficiency of the associated burner and furnace or other fired heater will improve. Accordingly, in the firing of liquid fuels, and particularly heavy fuel oils associated with petroleum refinery process furnaces, it is highly desirable to efficiently and fully atomize such heavy fuel oils with injected steam. Therefore, any atomization improvements that may be effected will enhance the overall thermal efficiency of the associated fired heater since less excess air will need to be supplied in order to accomplish complete combustion of the fuel.

SUMMARY OF THE INVENTION

In accordance with the present invention an improved liquid fuel atomizing gun and method is disclosed wherein optimal efficiency atomization is accomplished by introducing liquid fuel under pressure in a first swirling spiral direction into a mixing chamber. The mixing chamber also includes means for introducing steam through a plurality of inclined orifices to introduce the steam and impact the sprayed liquid fuel in a contra-rotational swirl direction. This arrangement of opposite swirling directions of the injected fuel and steam in the gun mixing chamber produces maximum turbulence between the two fluids as each impinge upon the other in relative close proximity so that the kinetic energy of each stream, both oil and steam, is released as the opposing streams meet, atomizing the fuel oil. The impact of such opposed liquid fuel and steam streams produces higher Reynolds numbers which result in additional turbulence for enhanced mixing.

Accordingly, it is a principle object of the invention to provide a new and novel atomizing apparatus and method wherein the kinetic energy of the sprayed liquid fuel and injected steam stream are released in close proximity to one another in opposed swirling vortices.

Another object of the invention is to provide an improved liquid fuel atomizing gun wherein improved atomization will occur within a mixing chamber of the gun prior to release from the gun tip.

A still further object of the invention is to provide an improved heavy fuel oil atomizing gun employing superheated steam which is simple in design, rugged in construciton, trouble free in operation and economical to manufacture.

These and other objects and advantages of the invention will become apparent and the invention will be fully understood from the following description and drawings.

DETAILED DESCRIPTION OF THE INVENTION

Figure 3:
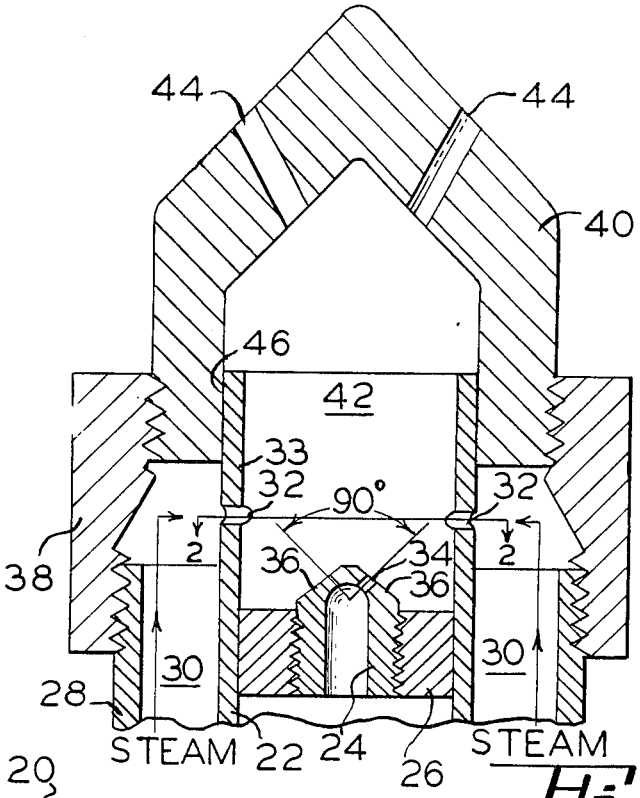
FIG. 3 is a fragmentary cross sectional view of the gun tip taken, in part, along line 3—3 of FIG. 2.
Figure 1:
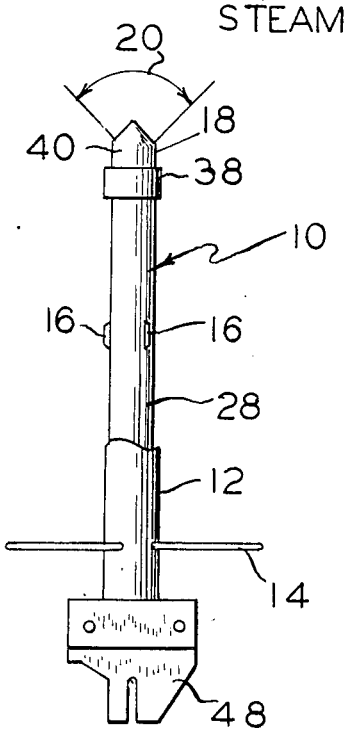
FIG. 1 is a side elevation view showing the atomizing gun of the invention as it would be mounted in a fragmentarily shown portion of a typical burner in a furnace wall or floor.
Figure 2:
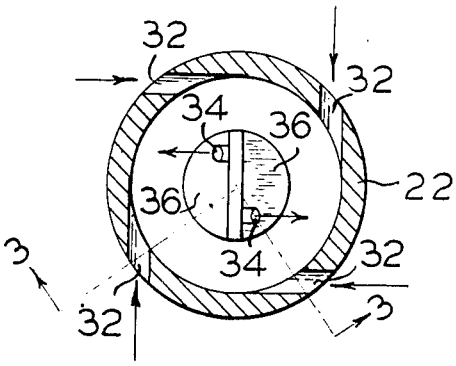
FIG. 2 is a cross sectional view of the atomizer gun tip taken along line 2—2 of FIG. 3.

Referring to the drawings, a fuel atomizing gun shown generally at 10 is mounted and supported by a guide tube 12 projecting through an end plate 14 of a burner. It will be understood that the present fuel atomizing gun may be used in association with high intensity burners, as shown in U.S. Pat. Nos. 3,476,494 or 3,746,499, assigned to the same assignee as the present application, whose individual specifications are incorporated herein by reference. Typically, the burner shown in the aforementioned patents is mounted in a side or bottom wall of a petroleum process furnace (not shown). The outer peripheral surface of the atomizer gun 10 includes a plurality of centering and support pads 16 which stabilize the gun within the guide tube 12. The atomizing gun assembly 10 includes a tip or nozzle 18 which sprays atomized fuel into the associated combustion chamber of the burner (not shown) at any desired fuel spray angle, designated 20.

As will be seen by reference to FIG. 3, showing an enlarged cross section of the atomizing gun tip 18, a fuel tube 22 includes a fuel spray nozzle 24 threaded into a surrounding support collar 26 suitably affixed to the inner diameter of fuel tube 22. Disposed about and surrounding the fuel tube 22 is a concentric steam tube 28 to define an annular steam passageway 30 in cooperation with the tube 22. The steam passageway will be understood, in a preferred embodiment of the invention, to supply steam at about 130 to 150 psig in a superheated state from about 600° F. to 750° F. to a plurality of tangential steam orifices 32. These steam orifices extend through the wall of the fuel tube 22 to inject steam in a clockwise helical vortex into an extension 33 of the fuel tube 22. The fuel spray nozzle 24 also includes a pair of tangential fuel ejection orifices 34 which are effective to discharge liquid fuel into the area downstream of the nozzle 24 in a counterclockwise directional vortex. As this fuel ejected from the orifices 34 expands outwardly in a spray angle of approximately 90° it approaches the inner wall of the tube extension 33 in the approximate vicinity of the inwardly injected superheated steam emitting from the four orifices 32.

The end of the steam tube 28 includes a threaded portion engaging threaded collar 38 which, in turn, secures the gun tip 40 to the end of the fuel tube extension 33. The inner cavity of the gun tip 40 in cooperation with the fuel tube extension 33 forms a steam and liquid fuel mixing chamber 42 immediately downstream of the fuel spray nozzle 24. The nozzle 24 may include inclined facet surfaces 36 through which the fuel orifices 34 penetrate. The gun tip 40 includes two or more atomized fuel discharge orifices 44 which release the mixed and atomized steam/fuel mixture into the combustion chamber of the associated furnace burner (not shown). In the assembly of the atomizing gun, as best visualized in FIG. 3, it will be seen that the tip 40 may be threaded into engagement with the collar 38, either before attachment or the collar 38 to the steam tube 28 or after the latter has been secured to 28. In any event, however, it should recognized that the overlapping interface designated 46 between the gun tip 40 and the outside surface of the tube extension 33 will be free to rotate to facilitate ease of disassembly of the mechanism and change and replacement of the gun tip as required.

In operation of applicants' novel fuel atomizing gun and the practice of the novel method resulting form such apparatus it has been found that when the fuel oil which may be typically as heavy as 1° API gravity (heavy fuel oil) is supplied to orifices 34 at a fuel pressure range of about 170 psig to 250 psig and when the superheated steam in the range of about 600° F. to 750° F. is supplied to the orifices 32 at a pressure in the range of about between 130 psig and 150 psig that superior atomization of the heavy fuel oil will occur. This is because of the close proximity between the release of the kinetic energy of the expanding superheated steam through the orifices 32 to the release of the kinetic energy of the fuel being sprayed from orifices 34. Enhanced atomization is particularly obtained because of the opposite direction of rotation of the fuel and steam streams, as aforesaid described. Further, applicants' novel arrangement is such as to judicially select the relative discharge or escape passageway areas as between the total area of the gun tip discharge orifices 44 relative to the total area of the steam discharge orifices 32. It has been found that it is preferable to have the gun tip 40 orifice discharge area in the range of 2.5 to 3.5 times the steam orifice port area. Preferably, the optimum ratio is about 3.0 times the steam orifice 32 port area. In this way a balance is struck between the total two stage pressure drop between the supply pressures of the fuel oil and the steam and the combustion chamber pressure at substantially atmospheric pressure on the discharge side of the tip orifices 44. It is desirable to have most of the kinetic energy of the pressurized streams released in the oppositely swirling steam and liquid fuel vortices in the mixing chamber. This is accomplished by having relatively large discharge orifices 44 from the gun tip. Accordingly, the greater portion of the available kinetic energy of the pressurized steam and fuel streams is released in the mixing zone 42 immediately downstream of the spray nozzle 34.

While a specific embodiment of the invention has been shown and described in detail to illustrate the application of the inventive principles, it will be understood that the invention may be embodied otherwise without departing from such principles.

What is claimed is:

1. An improved liquid fuel atomizing gun comprising a liquid fuel tube having a first end and a second end; a steam tube concentrically surrounding said fuel tube to define an annular steam passageway about said fuel tube, and a hollow gun tip having atomized fuel ejection orifices cooperative with the first end of said fuel tube to define therewith a fuel and steam mixing chamber within the first end of said fuel tube; and fuel tube including fuel spray nozzle means having at least one orifice to spray liquid fuel outwardly from said nozzle into and substantially along the circumference of said mixing chamber in a first swirling direction and at least one steam orifice extending through said fuel tube first end to place said annular steam passageway in communication with said mixing chamber, said steam orifice being oriented to direct steam into and along the circumference of said mixing chamber in a swirling direction opposite to said first swirling direction of said liquid fuel, whereby the kinetic energy of the pressurized steam and fuel streams flowing in the steam passageway and the fuel tube is preserved until atomization occurs in said mixing chamber when said steam and liquid fuel meet in opposite swirl directions.

2. The combination of claim 1 wherein said fuel spray nozzle means includes two tangential orifices arranged to discharge fuel at a 90° spray angle into said mixing chamber and wherein said fuel tube first end includes four steam orifices disposed downstream of said fuel spray nozzle means at approximately the point where the fuel spray contacts said fuel tube.

3. The combination of claim 2 further including threaded collar means securing said gun tip to a first end of said steam tube.

4. The combination of claim 3 wherein said steam passageway injects superheated steam at 150 psig in a temperature range between 600° F. and 750° F. through said steam orifices into said mixing chamber.

5. An improved heavy fuel oil atomizing gun for a burner comprising a circular liquid fuel tube having a first end and a second end; a circular steam tube concentrically surrounding said fuel tube to define an annular steam passageway about said fuel tube, and a hollow gun tip cooperative with the first end of said fuel tube to define therewith a fuel and steam mixing chamber within the first end of said fuel tube; said fuel tube including fuel spray nozzle means having at least two orifices to spray liquid fuel outwardly into and substantially along the circumference of said mixing chamber in a first swirling direction and at least one steam orifice extending through said fuel tube first end to place said annular steam passageway in communication with said mixing chamber, said steam orifice being oriented to direct steam into and substantially along the circumference of said mixing chamber in a swirling direction opposite to said first swirling direction of said liquid fuel, whereby said steam and liquid fuel meet in said mixing chamber in opposite swirl directions.

6. The combination of claim 5 wherein said fuel spray nozzle means orifices are arranged to discharge fuel at a 90° spray angle into said mixing chamber and wherein said fuel tube first end includes four steam orifices disposed downstream of said fuel spray nozzle means at approximately the point where the fuel spray impinges upon the interior wall of said fuel tube.

7. The combination of claim 6 further including threaded collar means securing said gun tip to a first end of said steam tube.

8. The combination of claim 7 wherein said steam passageway injects superheated steam at about 130 to 150 psig in a temperature range between about 600° F. and 750° F. through said steam orifices into said mixing chamber, and wherein said gun tip includes atomized fuel ejection orifice means for discharge of atomized heavy fuel oil into an associated burner for improved combustion thereof.

9. The method of atomizing a liquid fuel with steam prior to ejection from the tip of a fuel gun having an inner fuel tube and a steam tube surrounding said fuel tube to define an annular steam passageway about said fuel tube, comprising the steps of: spraying liquid fuel outwardly through one or more orifices into and substantially along the circumference of a mixing chamber defined by the gun tip and an end of said liquid tube to establish a swirling of said liquid fuel in a first direction in said mixing chamber, and introducing steam from said steam passageway into and substantially along the circumference of said mixing chamber in a swirling direction opposite to said first direction, whereby said steam and fuel meet in said mixing chamber in opposite swirl directions.

10. The method of claim 9 including the further step of ejecting atomized fuel from said mixing chamber through orifices in said gun tip, and whereby the fuel and steam streams meet at maximum kinetic energy which is released when atomization occurs in said mixing chamber.

11. The method of claim 10 employing 150 psig superheated steam in a temperature range between about 600° F. and 750° F. and liquid fuel of about 1° API gravity.

* * * * *